United States Patent [19]

Bodendorfer

[11] 4,176,857

[45] Dec. 4, 1979

[54] SAFETY SKI BINDING

[75] Inventor: Roland Bodendorfer, Vienna, Austria

[73] Assignee: TMC Corporation, Baar, Switzerland

[21] Appl. No.: 891,750

[22] Filed: Mar. 30, 1978

[30] Foreign Application Priority Data

Apr. 4, 1977 [AT] Austria ..... 2325/77

[51] Int. Cl.[2] ..... A63C 9/08

[52] U.S. Cl. ..... 280/613; 280/616; 280/624

[58] Field of Search ..... 280/613, 624, 616, 618, 280/617, 620, 636, 623, 611

[56] References Cited

U.S. PATENT DOCUMENTS

| | | | |
|---|---|---|---|
| 3,785,668 | 1/1974 | Marker | 280/613 |
| 3,845,964 | 11/1974 | Johnson | 280/636 X |
| 3,944,240 | 3/1976 | Bodendorfer | 280/613 |

*Primary Examiner*—Joseph F. Peters, Jr.
*Assistant Examiner*—Milton L. Smith
*Attorney, Agent, or Firm*—Blanchard, Flynn, Thiel, Boutell & Tanis

[57] ABSTRACT

A safety ski binding having a base plate secured to a ski and a push rod movably mounted on the base plate and adapted to be displaceable against spring force along the axis of symmetry of the base plate. The axis of symmetry extends in the longitudinal direction of the ski. The push rod is adapted to be held in position by a tensioning device. A pair of rollers is carried by the push rod and the base plate, one roller being movable toward and away from the other roller. The axles of the rollers extend transversely to the longitudinal axis of the push rod and parallel to the base plate. The bottom of the heel portion of the ski boot has a longitudinally extending groove therein. The upper surface of the base plate has in the central portion thereon an upstanding truncated cone adapted to be received in the groove in the heel of the ski boot. The surface of the truncated cone engages the side walls of the groove in the heel of the ski boot and permits a rotational movement of the heel about a vertical axis relative to the base plate during a release of the ski boot from the ski.

10 Claims, 5 Drawing Figures

FIG.2

FIG. 1
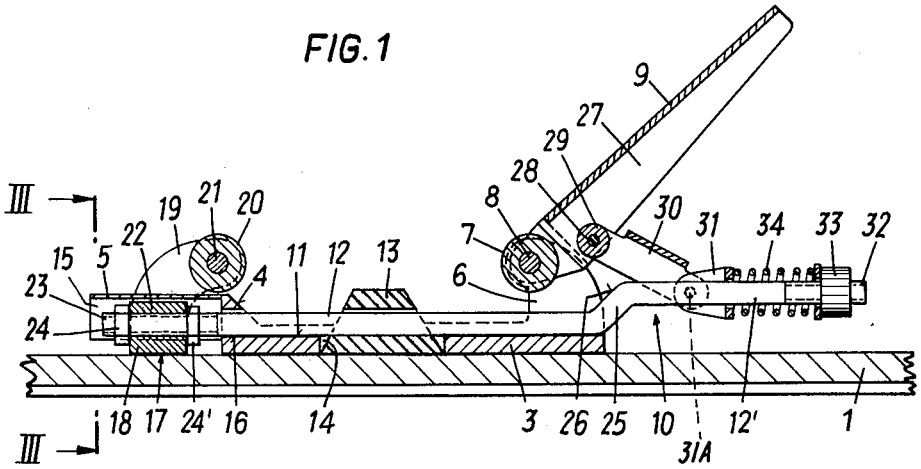
FIG. 2
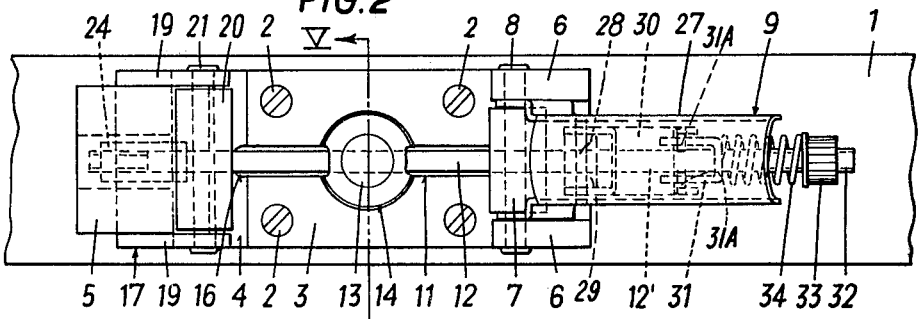
FIG. 3
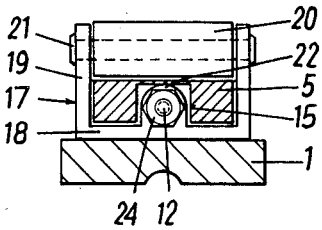
FIG. 4
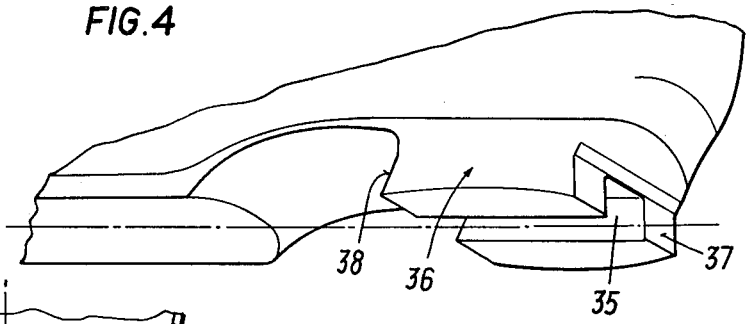
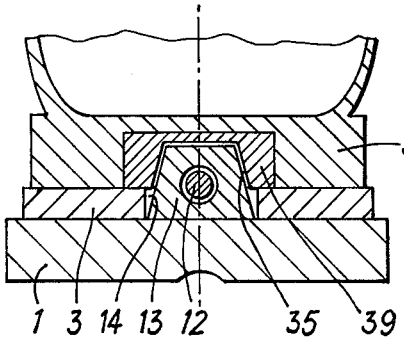
FIG. 5

SAFETY SKI BINDING

FIELD OF THE INVENTION

The invention relates to a safety ski binding comprising a pull rod which extends in longitudinal direction of the ski and is arranged movably in same against the force of a spring and can be operated by a tensioning device, the one end of which pull rod supports at least one roller which engages a locking surface on the heel of the boot, opposite of which roller is at least one further roller which is supported independently from the pull rod for engagement with a counter-surface on the heel of the boot.

BACKGROUND OF THE INVENTION

Ski bindings of this type are described in Austrian Pat. No. 332 768 and U.S. Pat. No. 3,944,240. They are used to hold the boot heel in place on the ski and have for this purpose two rollers, between which the boot heel is held by operating the tensioning device. The pull rod is guided partly within a tube-shaped housing supported on a stepping plate and received during skiing in a longitudinal groove in the boot heel. In the case of a fall forward, the heel pulls the pull rod forwardly by overcoming the force of the spring, which causes the pull rod to open the tensioning device through a nose. In the case of a twist fall, the stepping plate, including the rollers and the tensioning device, is pivoted with respect to a base plate and a release mechanism at the same time opens the tensioning device.

The purpose of the present invention is to provide structure which achieves a simplification of the release mechanism. To attain the set purpose the invention provides that in a safety ski binding of the above-mentioned type, the pull rod is guided in a ski-fixed cone or a truncated cone. Constructions of this type offer the possibility that the boot can rotate during a twist fall about the cone which engages a corresponding opening in the heel and can thereby be freed from the binding without needing for this a pivotal support plate of the aforedescribed type.

BRIEF DESCRIPTION OF THE DRAWINGS

Further details of the invention will be discussed more in detail with reference to the drawing, in which one exemplary embodiment of the inventive safety ski binding is illustrated.

FIG. 1 is an axial longitudinal cross-sectional view of a safety ski binding embodying my invention;

FIG. 2 is a top view thereof;

FIG. 3 is a cross-sectional view taken along the line III—III of FIG. 1;

FIG. 4 is a bottom view showing a portion of a ski boot with a boot heel designed for use with the inventive safety ski binding; and FIG. 5 is a sectional view taken along the line V—V in FIG. 3 and showing the heel of a ski boot cooperating with the frustrum.

DETAILED DESCRIPTION

The inventive safety ski binding has a base plate 3 which is secured to a ski 1 by means of four screws 2. The forward end of the base plate, namely, the end which faces the tip of the ski, has an inclined rising ramp surface 4 thereat terminating at the forwardmost end in a web 5 which is close to but spaced above the upper surface of the ski. The other or rearward end of the base plate has a pair of laterally spaced bearing blocks 6 for supporting an axle 8 on which a roller 7 is rotatably supported and serving to engage and support the boot heel. The axle 8 of the roller 7 has one end of a tensioning lever 9 of a tensioning device 10 pivotally secured thereto. The base plate 3 has a guide groove 11 therein for a pull rod 12 which extends along the longitudinal center of the base plate 3, which pull rod 12 also extends through a frustrum 13 of a cone which is arranged equidistant from the screws 2 and which is positioned with a wider base in a corresponding opening 14 on the base plate 3. The guide groove 11 extends over the entire length of the base plate and is continued at the front end of the same, which front end is on the side facing the ski tip, in a longitudinally extending bore 16 through the ramp 4 and terminates in a central downwardly opening longitudinal groove 15 in the web 5.

The web 5 is less wide than the base plate 3 and forms a guideway for a generally W-shaped (see FIG. 3) bridge part 17, which with its bottom web 18 extends beneath the web 5 and has laterally spaced bearing blocks 19 on the outer legs of the W. An axle 21 is supported in the bearing blocks 19 and a roller 20 is rotatably supported on the axle 21 and functions as a counter-roller for the roller 7, so that the ski boot heel, as will be described later on, can be clamped between these two rollers 20, 7. A bearing block 22 is positioned in the longitudinal center or middle leg of the web 18 and rises upwardly therefrom for the support of the pull rod 12 on the end of the base plate facing the tip of the ski. The forwardmost end of the pull rod 12 extends through the bearing block 22 and is for this purpose provided with an external thread 23 for threadedly receiving two nuts 24, 24' thereon, between which the bearing block 22 is clamped.

The rearward end portion of the pull rod 12 has spaced from the terminal end thereof an upwardly directed section 25 with a sloped abutting surface 26, which forms the release mechanism for the tensioning device 10. For this purpose a roller 29 is supported on the tensioning lever 9 near its jointed axle 8 and between the laterally spaced sides 27 thereon. An axle 28 is secured to and extends between the lateral sides 27 and supports the roller 29. A guide rod 30 is pivotally supported on the axle 28 of said roller 29, the other end of said guide rod being pivotally connected as at 31A to a slide member 31 which is guided along the upper longitudinal part 12' of the pull rod 12 between the section 25 and the rear end thereof. The slide member is held under the influence of a spring 34 engaging and extending between an adjusting nut 33 which is threadedly engaged with the terminal end 32 of the part 12' and the slide member. The spring 34 determines the closing force for the clamped-in boot heel 36. The boot heel has, as is shown in FIG. 4, a central longitudinal groove 35 therein and frontwardly and rearwardly facing stop surfaces 37 and 38, against which the rollers 7 and 20, respectively, engage.

FIG. 5 illustrates the heel 36 of the ski boot cooperating with the frustrum 13 of the cone. The groove 35 has side walls inclined to the same degree as the inclination of the surface of the frustrum. In this particular embodiment, the groove 35 is lined with an insert 39 which is made of a durable, wear resistant material, such as metal.

OPERATION

The described safety ski binding operates in the following manner: When the tensioning lever 9 is open (in the FIG. 1 position), the pull rod 12 is moved forwardly, so that the roller 20 is spaced farther from the roller 7 than is the longitudinal length of the boot heel, so that the skier can step with the heel between said rollers 20, 7. The pull rod 12 and the frustrum 13 of the cone are received into the longitudinal groove 35 in the heel 36. If subsequently the tensioning lever 9 is pressed down, it effects a movement of the pull rod 12 axially rearwardly so that the springs 34 will become compressed and the roller 20 pressed against the surface 38 of the boot heel 36 with a force equal to the return force of the spring 34. In addition, the roller 29 engages the surface 26 and the roller 7 engages the counter-surface 37.

In the case of a dangerous fall forwardly, the boot heel has the tendency to lift off from the ski and applies pressure to the roller 20, which tends to move the pull rod 12 against the force of the spring 34 toward the tip of the ski. During this movement of the rod 12, the sloped abutting surface 26 lifts the roller 29 engaged therewith until its axle 28 is moved from a position which lies in the closed position of the binding below the line extending between the axle 8 and connection 31A into a position which lies above the aforementioned line, at which the tensioning lever 9 jumps into the open position under the action of the spring 34. Furthermore, the stop surface 38 of the boot heel 36 runs onto the ramp 4 and roller 20 and is lifted off and can thereby be released from the truncated cone 13. In the case of a dangerous twisting fall, the heel 36 presses again the stop surface 38 against the ramp 4, however, in this case in the area of one or the other front corners of the heel, onto the roller 20, so that the aforementioned operation is repeated.

The base plate 3, the truncated cone 13 and the roller 28 are preferably manufactured of plastic. The remaining parts are preferably made of metal.

Of course, various structural modifications can be made within the scope of the invention. Thus, it is for example possible, to provide a slotted guide in the place of the web 5, into which slotted guide engages the bridge part 17 with a laterally projecting pin.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. The combination of a ski boot having a heel with first and second locking surfaces thereon and a safety ski binding releasably operatively connectible to said first and second locking surfaces, said combination comprising:

a base plate adapted to be secured to a ski;

guide means on said base plate;

an elongated pull rod reciprocally guided in said guide means, said pull rod having first ski boot engaging means secured thereto and movable therewith;

tensioning lever means, which includes second ski boot engaging means, operatively connected to said pull rod for effecting a releasable locking engagement of said first and second locking surfaces with said first and second ski boot engaging means; and upstanding pivot means fixed relative to said ski and means defining a recess in said heel receiving said pivot means therein to facilitate a pivotal support for said heel relative to said ski, said upstanding pivot means being positioned between said first and second ski boot engaging means and on a central longitudinal center line for said base plate.

2. The combination according to claim 1, wherein said pivot means comprises an upstanding conically surfaced member on said ski, the conical surface of which converges to an apex spaced above said base plate, and wherein said guide means includes a passageway through the base of said conically surfaced member receiving said pull rod therethrough.

3. The combination according to claim 2, wherein said conically surfaced member is a truncated cone.

4. The combination according to claim 3, wherein said truncated cone is positioned with its larger end surface in an opening in said base plate, wherein said base plate has at its end closest to the tip of said ski a web with a sloped ramp thereon, said web being spaced from the upper surface of said ski and guiding a holder for movement along the longitudinal axis of said ski.

5. The combination according to claim 4, wherein said first ski boot engaging means is a roller rotatably supported in said holder about an axis extending transversely of said longitudinal axis of said ski.

6. The combination according to claim 5, wherein said holder is constructed as a bridge part having an intermediate section which extends under said web on said base plate and has laterally spaced bearing blocks thereon supporting said roller therebetween.

7. The combination according to claim 6, wherein said holder has means thereon coupled to said pull rod, and wherein said web on said base plate has a central longitudinal groove in the underside thereof reciprocally guiding said holder and said pull rod therein.

8. The combination according to claim 7, wherein an opening is provided in said sloped ramp and wherein said guide means includes a groove in the longitudinal center of said base plate axially aligned with and communicating with said passageway through said truncated cone and said opening in said sloped ramp.

9. The combination according to claim 2, wherein said pull rod effects a coupling of said conically surfaced member to said base plate.

10. The combination according to claim 1, wherein said tensioning lever means is pivotally secured to said base plate for movement between first and second positions, said second ski boot engaging means being spaced longitudinally along said axis of said ski from said first ski boot engaging means and resilient means connected between said pull rod and said tensioning lever means for effecting a resilient urging of said pull rod for movement along said longitudinal axis of said ski in response to a pivoting of said tensioning lever means from said first position toward said second position to effectively move said first ski boot engaging means toward said second ski boot engaging means, the existence of said heel between said first and second ski boot engaging means causing said resilient means to resiliently yield to a continued movement of said tensioning lever means toward said second position, the force of said yielding resilient means being transmitted through said pull rod to said first ski boot engaging means.

* * * * *